US011986085B2

(12) United States Patent
Norton

(10) Patent No.: US 11,986,085 B2
(45) Date of Patent: May 21, 2024

(54) PAINTBRUSH WITH ADJUSTABLE BRISTLES AND REMOVABLE HANDLE

(71) Applicant: Darryl Norton, Noblesville, IN (US)

(72) Inventor: Darryl Norton, Noblesville, IN (US)

( * ) Notice: Subject to any disclaimer, the term of this patent is extended or adjusted under 35 U.S.C. 154(b) by 195 days.

(21) Appl. No.: 17/592,687

(22) Filed: Feb. 4, 2022

(65) Prior Publication Data

US 2022/0279917 A1 Sep. 8, 2022

Related U.S. Application Data

(60) Provisional application No. 63/157,943, filed on Mar. 8, 2021.

(51) Int. Cl.
*A46B 7/02* (2006.01)
*A46B 5/00* (2006.01)

(52) U.S. Cl.
CPC ..... *A46B 7/023* (2013.01); *A46B 5/0095* (2013.01); *A46B 2200/202* (2013.01)

(58) Field of Classification Search
CPC . A46B 7/023; A46B 2200/202; A46B 5/0095; A46B 9/10
USPC ..... 15/184
See application file for complete search history.

(56) References Cited

U.S. PATENT DOCUMENTS

2011/0239392 A1* 10/2011 Levy ..... A46B 15/0095 15/207.2
2017/0188692 A1 7/2017 Doorey
2017/0332775 A1 11/2017 Anthony et al.

FOREIGN PATENT DOCUMENTS

DE 19834862 A1 * 2/2000 ..... A47F 9/046

* cited by examiner

*Primary Examiner* — Katina N. Henson
(74) *Attorney, Agent, or Firm* — Overhauser Law Offices, LLC

(57) ABSTRACT

An adjustable paintbrush with a removable handle allows adjustment of the width, length, and/or shape of the brush head or bristles of a paintbrush with a sliding mechanism. The adjustable brush head is movable between at least two positions within the brush body. An attachment member can also be used to attach and/or detach the handle from the paintbrush to allow attachment of foam paint heads, paint roller heads, and paint brushes with a variety of widths to the detachable handle.

2 Claims, 8 Drawing Sheets

PAINTBRUSH WITH ADJUSTABLE BRISTLES AND REMOVABLE HANDLE

CROSS-REFERENCE TO RELATED APPLICATIONS

This US non-provisional patent application claims the benefit of and priority to U.S. provisional patent application Ser. No. 63/157,943 filed 8 Mar. 2021, the entire contents of which is specifically incorporated herein by reference.

FIELD OF THE INVENTION

The present invention relates to paint brushes.

BACKGROUND

Paintbrushes have been used for many years to paint surfaces including the interior or exterior surfaces of a home, business, or other structure. Paintbrushes are typically comprised of a handle which the user holds with their hand and a brush head that contains the bristles that are used to retain and spread the paint.

Traditionally, paintbrushes are manufactured with a fixed bristle width, length, angle, and shape. Often, a painter needs to paint a surface that has an unusual shape, or a surface that has a smaller width than that of a standard paintbrush. The surface may also require bristles with an angled shape to allow for a better application of paint to the desired surface.

For example, paintbrushes with bristles that are cut at an angle are often used to make it easier to paint clean lines. They are also used to paint anything with grooves, such as cabinets, furniture, or paneled doors, or when a user is painting close to another surface, such as between window trim and walls.

Traditional paintbrushes do not have options for adjusting the width, length, angle, or shape of the paintbrush bristles' application surface to allow for a neat and controlled application of paint to the surface being painted. This requires the painter to maintain and utilize multiple paintbrushes of different sizes, widths, and bristle configurations. The painter then has to switch paintbrushes as needed which takes additional time and multiple paintbrushes.

Anthony (U.S. Pub. No. US 2017/0332775 A1) discloses a paintbrush having a plurality of individual bristle pack segments maintained within a brush slide body housing. The individual bristle pack segments are then able to slide, independently of one another, in and out of the brush slide body housing to create different lengths and shapes of the brush bristles.

Doorey (U.S. Pub. No. US 2017/0188692 A1) discloses an adjustable paintbrush wherein the bristles are contained within a rotatable ferrule within the paintbrush. This allows the painter to adjust the painting angle by adjusting the rotatable ferrule and utilizing a locking mechanism to lock the bristles and ferrule in place. However, this does not allow for the adjustability of the length or shape of the bristles.

While the aforementioned inventions may be suitable for the particular purpose they address, the inventor has determined that there remains a need for a paintbrush which allows the painter to adjust the application surface's shape and/or length with a single sliding mechanism.

SUMMARY OF THE INVENTION

One object of the present invention is to allow a painter to adjust the width, length, and/or shape of the bristles or brush head (collectively, "bristles") of a paintbrush with a single sliding mechanism. The bristles and handle can be adjusted to create the proper bristle shape and brush handle length for painting in tight spaces, on specific textures, or in broad strokes, for example. Attachment members can also be used to attach a handle to the paintbrush. This further allows the attachment of paint roller heads and paint brushes with a variety of widths to the detachable handle.

To attain these objects, an adjustable bristle pack having a top end and a bottom end is situated within a brush body having an open end and a closed end. The brush body is configured to accommodate the bristle pack and a sliding mechanism between the bristle pack and the closed end of the brush body. The adjustable bristle pack is attachable to the sliding mechanism for example, with a latch or magnet. The sliding mechanism has a length, a knob portion, and a first end opposite the knob portion. The length of the sliding mechanism is such that the first end is contained within the brush body while the knob portion is outside the brush body.

The sliding mechanism is then moveable between a first and second position. This allows the bristles to be adjusted as they are attached to the sliding mechanism. The first position is wherein the adjustable bristle pack is contained substantially within the brush body. The second position is wherein the top end of the bristle pack is within the brush body and the bottom end of the adjustable bristle pack is within the brush body.

Finally, the brush body has a handle attachable at the closed end. The handle may also be a removable or detachable handle by way of a first attachment member on the closed end of the brush body and a second attachment member on the handle. The first and second attachment members are attachable to each other, making the handle removeable from the brush body. The attachment members can be a depressible button coupling, for example. The bristles (or brush) head may be biased toward

DETAILED DESCRIPTION

Figure 1:
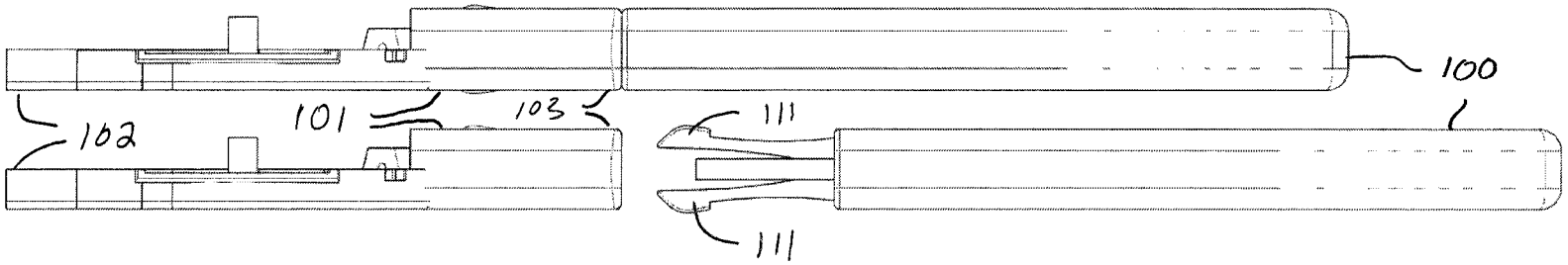
FIG. 1 shows a side view of an adjustable paintbrush with a detachable handle, with the handle both attached and detached.

The present invention provides an adjustable paintbrush with a single sliding mechanism to move a brush head between extended and retracted positions. FIG. 1 shows a side view of an adjustable paintbrush with a detachable handle 100 that fits into brush body 101 and is secured thereto by handle arms 111. When in the handle, arms 11 may be depressed to remove handle 100 from brush body 101. Brush body 101 has a top end 102 and a bottom end 103. Alternatively, a bush body with holes to engage the handle arms 111 may be formed that holds a paint roller a foam paint heads, or other paint application component.

Figure 2:
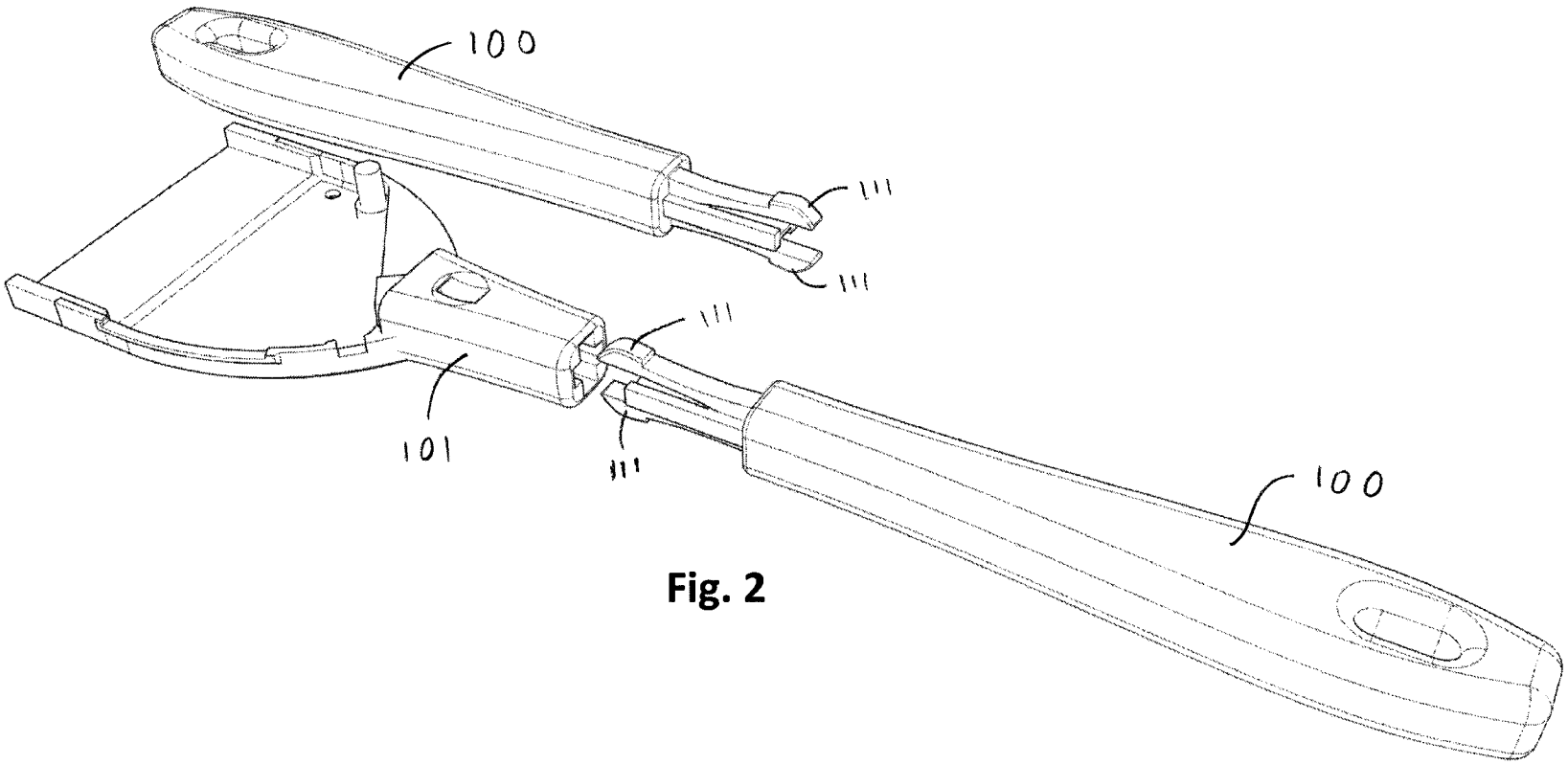
FIG. 2 shows a handle having arms that are insertable into a brush body.

FIG. 2 shows a handle 100 having arms 111 that are detachably insertable into a recess in brush body 101.

Figure 3:
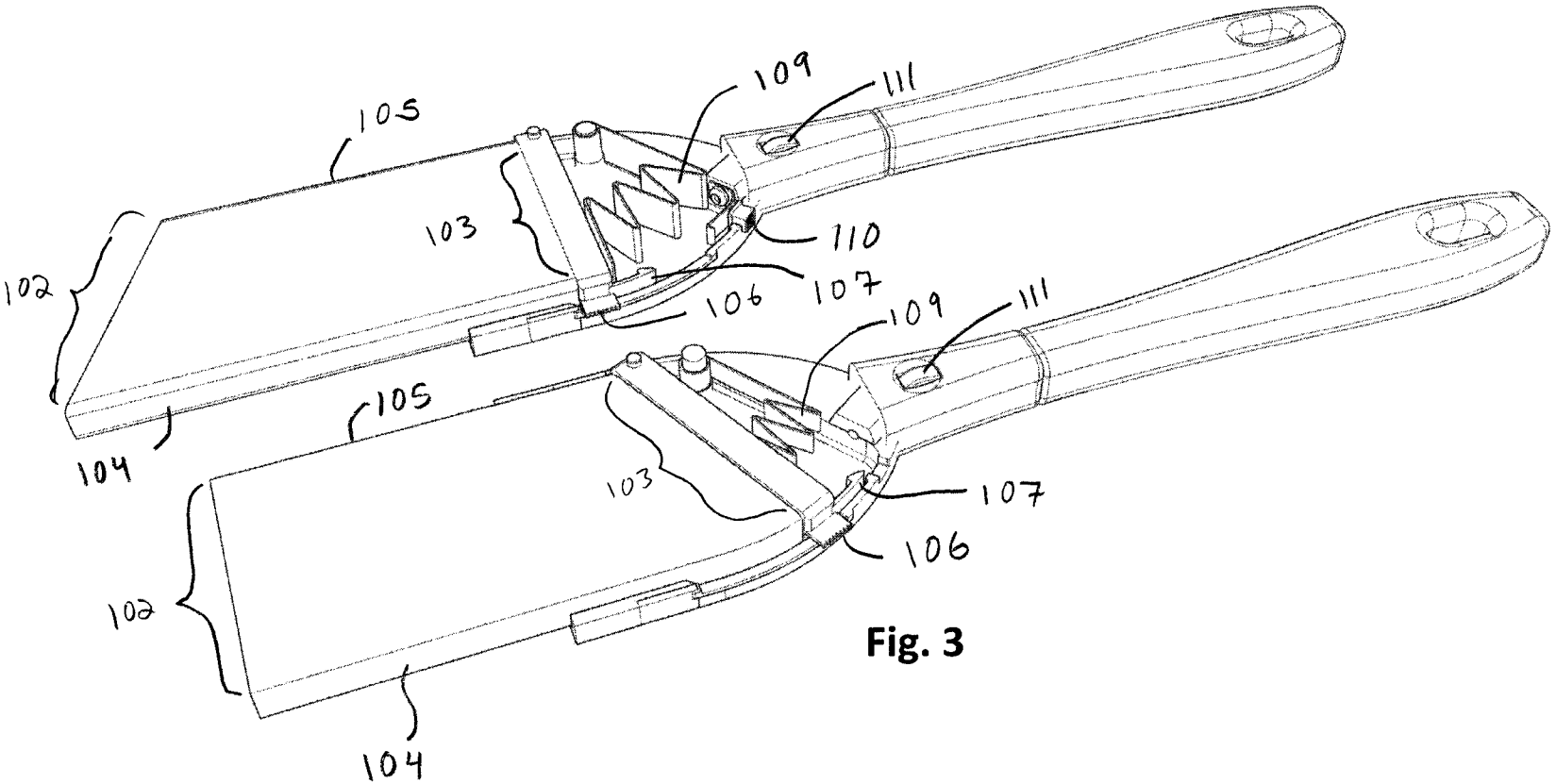
FIG. 3 shows a brush body with the brush head in both extended and retracted positions, with a top cover of the brush body removed to show its interior components.

FIG. 3 shows a brush body with the brush head in both extended and retracted positions, with a top cover of the brush body removed to show its interior components. In the upper portion, spring 109 extends bush head so that its first side 104 projects further from brush body 101 that left side, which creates a tapered tip for brush head along its top end 102. Slider grip 106 is attached to the brush head bottom end 103 and is pushed towards the brush head top end 102 to so extend the brush head first side 104. In bottom portion of FIG. 3, slider grip 106 is retracted against the force of spring 109 toward the handle so that brush head top end is perpendicular to both brush head first side 104 and second side 105.

Figure 4:
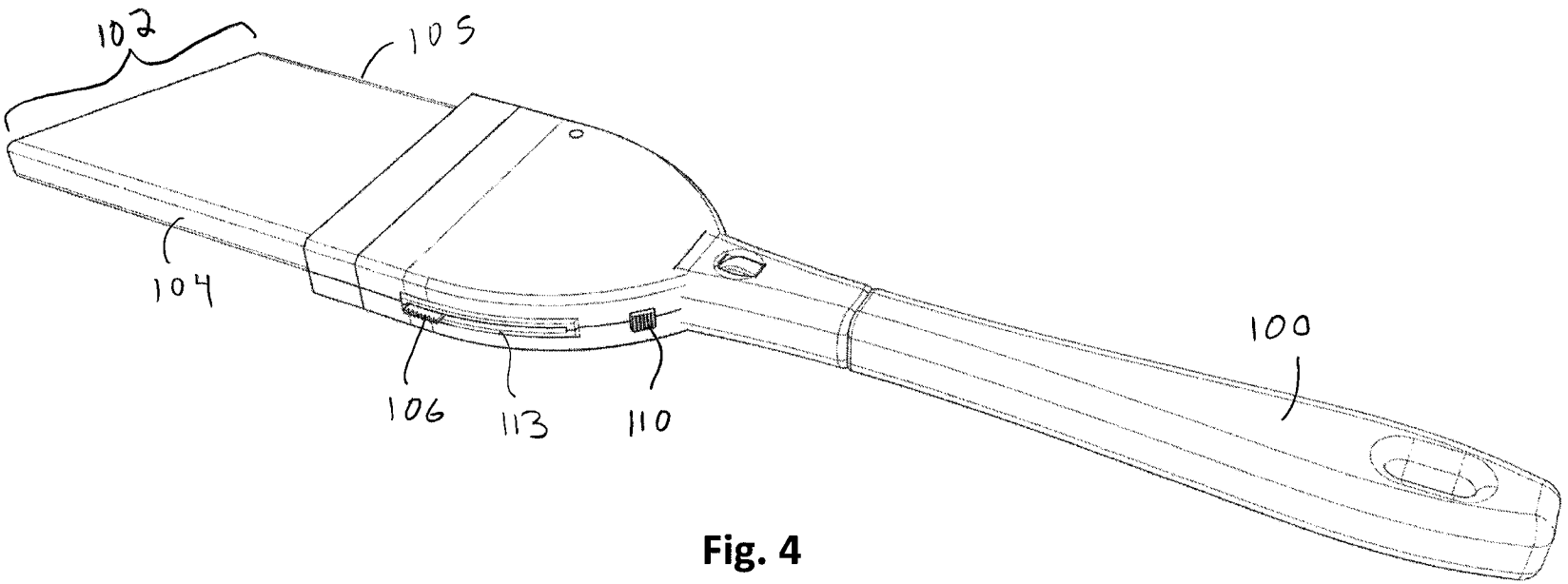
FIG. 4 shows a brush body with the brush head in an extended position.

FIG. 4 shows a paintbrush with brush body 101 holding the brush head in an extended position. Slider grip 106 extends form slot 113 in the side of brush body 101. In this position, an acute angle is formed by the brush head top end 102 and first side 104.

Figure 5:
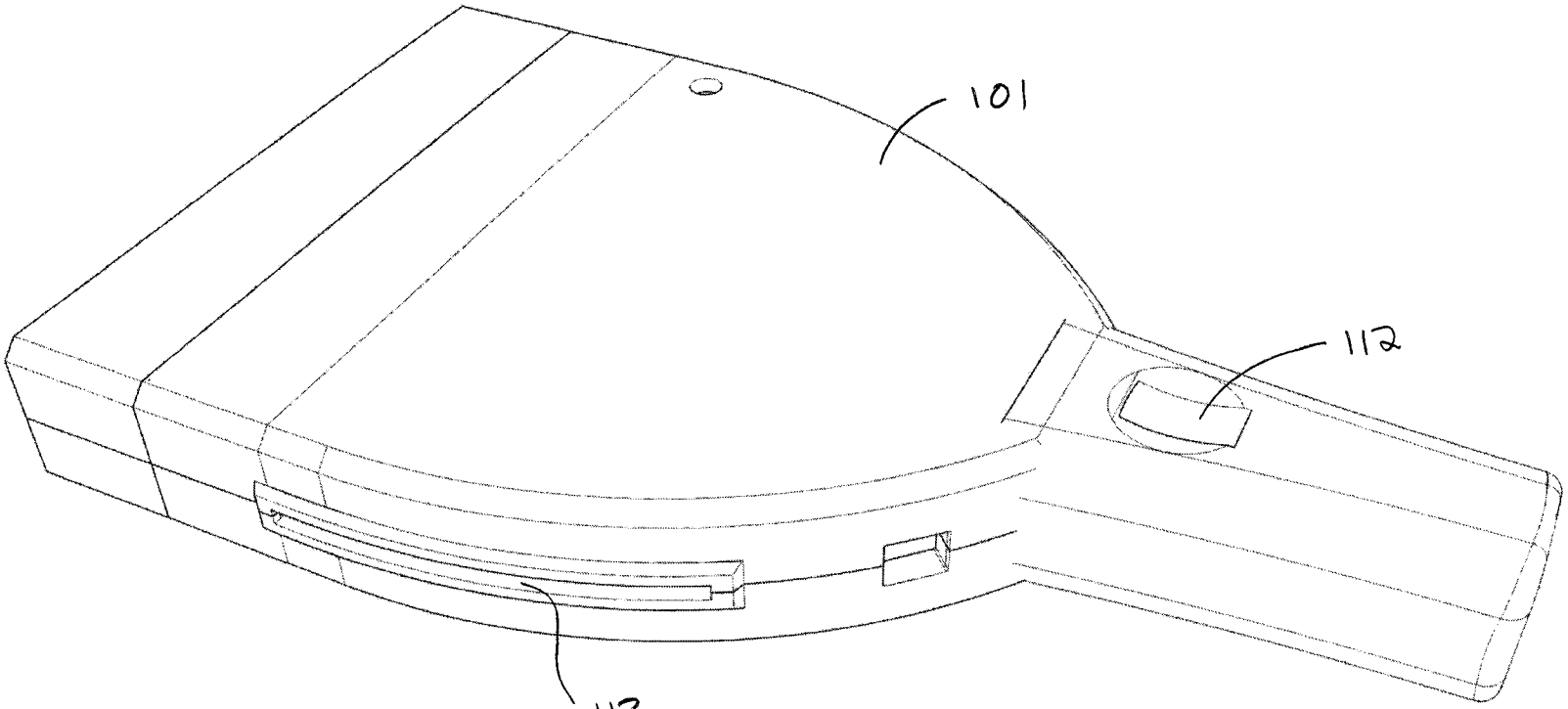
FIG. 5 shows the shell of brush body without the slider grip or release button extending from the body.

FIG. 5 shows the shell of brush body 101 without the slider grip extending from slot 113, and without the release button extending from the body. Brush body 101 may be comprised of plastic.

Figure 6:
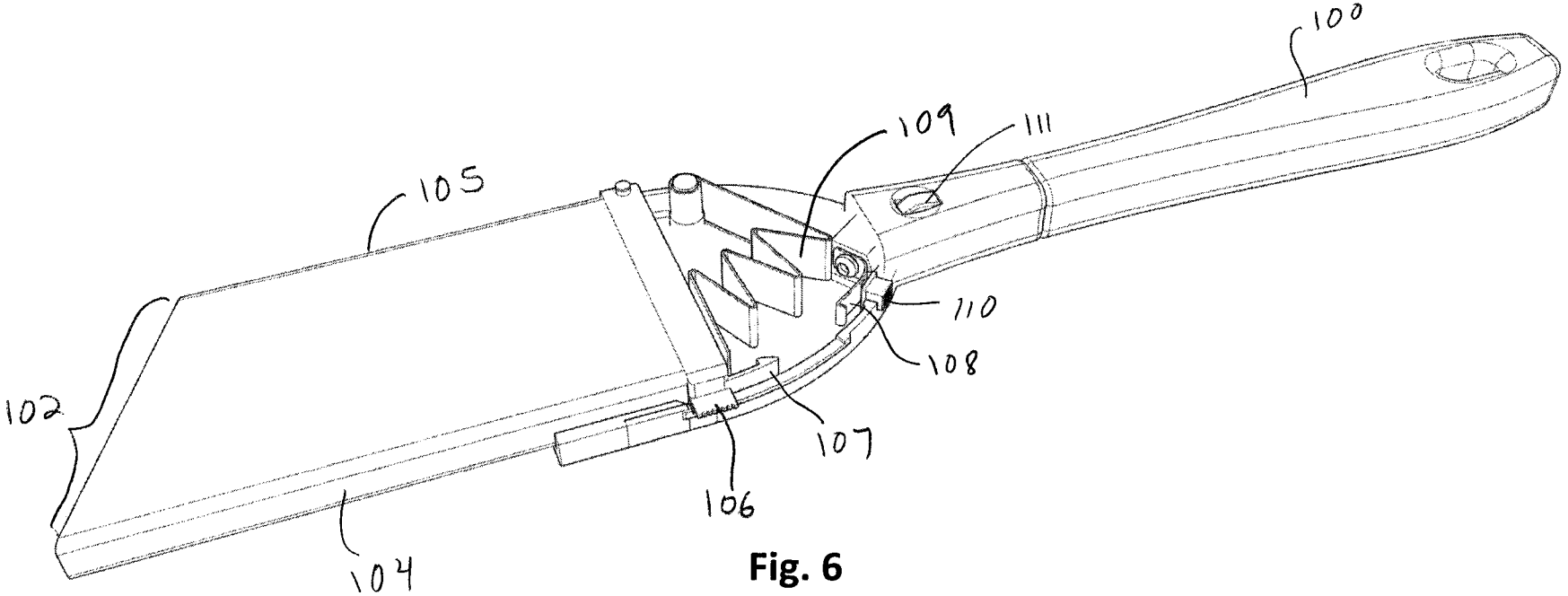
FIG. 6 shows a partial cut-away of a brush body with the brush head in an extended position, with a top cover of the brush body removed to show its interior components.

FIG. 6 shows a partial cut-away of a brush body 101 with the brush head in an extended position, with a top cover of the brush body removed to show its interior components, namely spring 109 and release button 110. Slider grip 106 includes catch 107, which engages with mating catch 108 when slider grip 106 is moved toward handle 100. To release slider grip 106, release button 110 is depressed, and spring 109 will cause slider grip to pivot to thereby extend brush head first side 104 away from handle 100.

Figure 7:
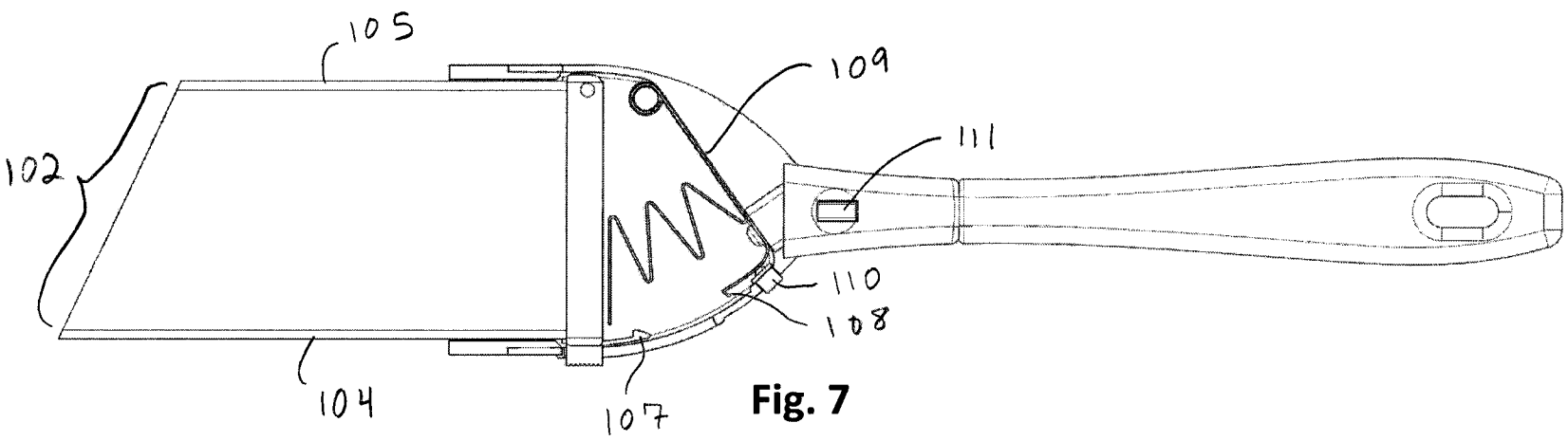
FIG. 7 is a top view of a brush body with the brush head in an extended position, with a top cover of the brush body removed to show its interior components, and with the handle attached to the brush body.

FIG. 7 is a top view of a brush body with the brush head in an extended position, with a top cover of the brush body removed to show its interior components, and with the handle attached to the brush body. Spring 109 may be shaped to have an acute angle at its end to form mating catch 108 which is sized to receive catch 107.

Figure 8:
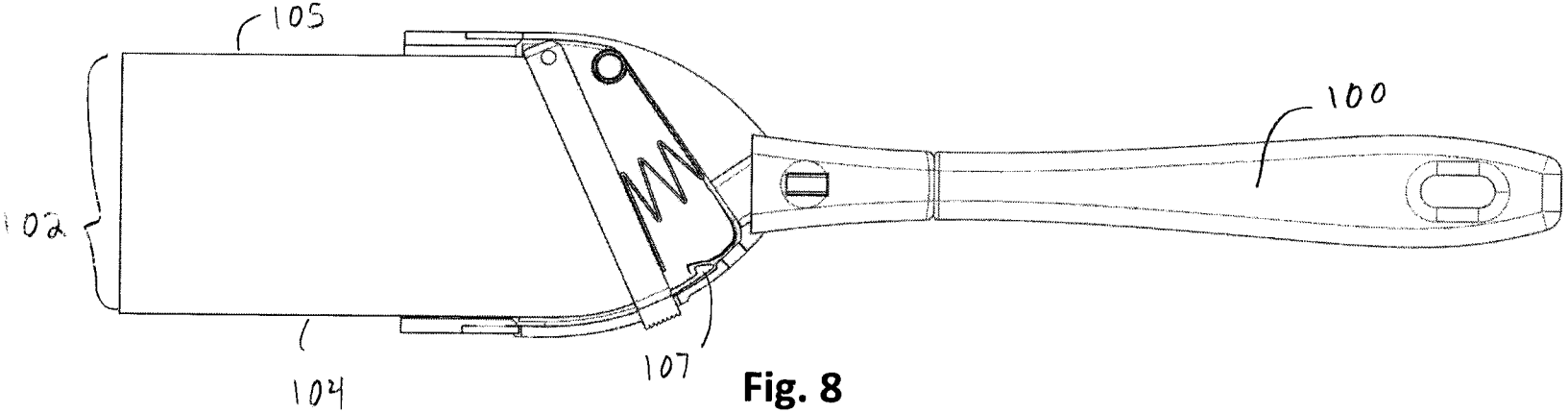
FIG. 8 is a top view of a brush body with the brush head in an retracted position, with a top cover of the brush body removed to show its interior components, and with the handle attached to the brush body.

FIG. 8 is a top view of a brush body with the brush head in an retracted position, with a top cover of the brush body removed to show its interior components. Catch 107 engages mating catch 108 to maintain the retracted position.

Those of skill in the art will understand that various details of the invention may be changed without departing from the spirit and scope of the invention. Furthermore, the foregoing description is for illustration only, and not for the purpose of limitation, the invention being defined by the claims. For example, while the attachment members in the drawings are depressible buttons, the attachment members can be comprised of various shapes and materials including, but not limited to, buttons, magnets, and Velcro. Further, the material to be used for the handle may be any suitable material including, but not limited to, wood, plastic, metal, and silicone.

All references cited in this specification are incorporated herein by reference to the extent that they supplement, explain, provide a background for or teach methodology or techniques employed herein.

What is claimed is:

1. An adjustable paintbrush comprising:

an adjustable brush head having a top end and a bottom end and a first side and a second side;

a brush body having an open end, a closed end, and configured to accommodate the adjustable brush head and a sliding mechanism operable to move the brush head between a first position in which the first and second sides of the brush head each extend from the brush body the same distance, and a second position in which the first and second sides of the brush head extend from the brush body different distances;

the sliding mechanism comprising slider grip, a catch, a mating catch, a depressible release button, and a spring extending between the sliding mechanism and the brush body, the sliding mechanism further comprising a knob portion extending outside the brush body, and a first end opposite the knob portion, and such that the knob portion is outside the brush body and such that the sliding mechanism may pivot at its first end, and a handle extending from the closed end of the brush body.

2. The adjustable paintbrush of claim 1 wherein:

the closed end of the brush body comprises a first attachment member;

the handle comprises a second attachment member; and the first and second attachment members are attachable to each other.

* * * * *